US010607539B2

(12) United States Patent
Chen et al.

(10) Patent No.: US 10,607,539 B2
(45) Date of Patent: Mar. 31, 2020

(54) ORGANIC LIGHT EMITTING DISPLAY APPARATUS AND PIXEL DRIVING CIRCUIT THAT COMPENSATES FOR A THRESHOLD VOLTAGE DEGRADATION OF A DRIVING TRANSISTOR

(71) Applicant: HON HAI PRECISION INDUSTRY CO., LTD., New Taipei (TW)

(72) Inventors: Po-Fu Chen, New Taipei (TW); Kuo-Sheng Lee, New Taipei (TW); Chung-Wen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/674,540

(22) Filed: Aug. 11, 2017

(65) Prior Publication Data

US 2018/0047336 A1 Feb. 15, 2018

Related U.S. Application Data

(60) Provisional application No. 62/374,101, filed on Aug. 12, 2016.

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2300/0814* (2013.01); *G09G 2300/0852* (2013.01); *G09G 2300/0861* (2013.01);

(Continued)

(58) Field of Classification Search
CPC .. G09G 3/3233; G09G 3/3266; G09G 3/3275; G09G 2330/02; G09G 2320/043; G09G 2300/0426; G09G 2310/08; G09G 2300/0852; G09G 2300/0814; G09G 2310/0245; G09G 2300/0866; G09G 2300/0861
See application file for complete search history.

(56) References Cited

U.S. PATENT DOCUMENTS

2006/0082528 A1* 4/2006 Guo ..... G09G 3/3233 345/82
2006/0267885 A1* 11/2006 Kwak ..... G09G 3/3233 345/76

(Continued)

*Primary Examiner* — Michael J Jansen, II
*Assistant Examiner* — Ivelisse Martinez Quiles
(74) *Attorney, Agent, or Firm* — ScienBiziP, P.C.

(57) ABSTRACT

A display apparatus comprises a plurality of scan lines and a plurality of data lines intersected with the scan lines in a grid, a plurality of pixel units, a first driving circuit for providing a plurality of scanning signals to the plurality of pixel units, and a plurality of pixel driving circuits. Each pixel driving circuit corresponds to one of the plurality of pixel units, and drives the corresponding pixel unit. Each pixel driving circuit comprises a switching transistor, a driving transistor, an organic light emitting diode and a reset transistor. The reset transistor pulls down a voltage applied on the driving transistor during a reset period under a control of a received another scanning signal having a phase previous to the scanning signal applied on a corresponding scan line being selected.

4 Claims, 15 Drawing Sheets

300

(52) U.S. Cl.
CPC ..... *G09G 2300/0866* (2013.01); *G09G 2310/0245* (2013.01); *G09G 2310/08* (2013.01); *G09G 2320/043* (2013.01); *G09G 2330/02* (2013.01)

(56) References Cited

U.S. PATENT DOCUMENTS

| | | | | |
|---|---|---|---|---|
| 2014/0009456 | A1 | 1/2014 | Kim et al. | |
| 2015/0123883 | A1* | 5/2015 | Lin | G09G 3/3233 345/76 |
| 2015/0138180 | A1* | 5/2015 | Park | G09G 3/3233 345/212 |
| 2015/0294626 | A1* | 10/2015 | Bi | G09G 3/3233 345/211 |
| 2016/0133185 | A1* | 5/2016 | Yoon | G09G 3/3233 345/76 |
| 2016/0171930 | A1* | 6/2016 | Song | G09G 3/3225 345/690 |
| 2017/0061870 | A1* | 3/2017 | Kang | G09G 3/3208 |
| 2017/0116925 | A1* | 4/2017 | Lee | G09G 3/3225 |
| 2017/0263186 | A1* | 9/2017 | Wang | G09G 3/3258 |
| 2018/0006263 | A1* | 1/2018 | Yoon | H01L 51/0508 |

* cited by examiner

ORGANIC LIGHT EMITTING DISPLAY APPARATUS AND PIXEL DRIVING CIRCUIT THAT COMPENSATES FOR A THRESHOLD VOLTAGE DEGRADATION OF A DRIVING TRANSISTOR

CROSS-REFERENCE TO RELATED APPLICATIONS

This application claims priority to U.S. provisional patent application No. 62/374,101 filed on Aug. 12, 2016, the contents of which are incorporated by reference herein.

FIELD

The present disclosure relates to a display apparatus.

BACKGROUND

An OLED display apparatus includes a plurality of pixels and a plurality of pixel driving circuits. Each of the pixels corresponds to one of the pixel driving circuit, and is driven by a gate driving circuit and a source driving circuit to display images. The driving circuit includes a driving transistor, a switching transistor, a capacitor, and an organic light emitting diode (OLED). The driving transistor controls a driving current flowing in the OLED. The capacitor uniformly holds a gate voltage of the driving transistor during one frame. The switching transistor stores a data voltage in the capacitor. The current flowing in the OLED relates to a lamination of the pixel. A threshold voltage of the driving transistor is adjustable depending on a process deviation, and electrical characteristics of the driving transistor are degraded based on a driving time. For achieving a desired luminance and increasing life span of the OLED display apparatus, thus a compensation circuit of the pixel driving circuit is needed. Therefore, there is room for improvement in the art.

BRIEF DESCRIPTION OF THE FIGURES

Implementations of the present technology will now be described, by way of example only, with reference to the attached figures, wherein.

DETAILED DESCRIPTION

Figure 1:
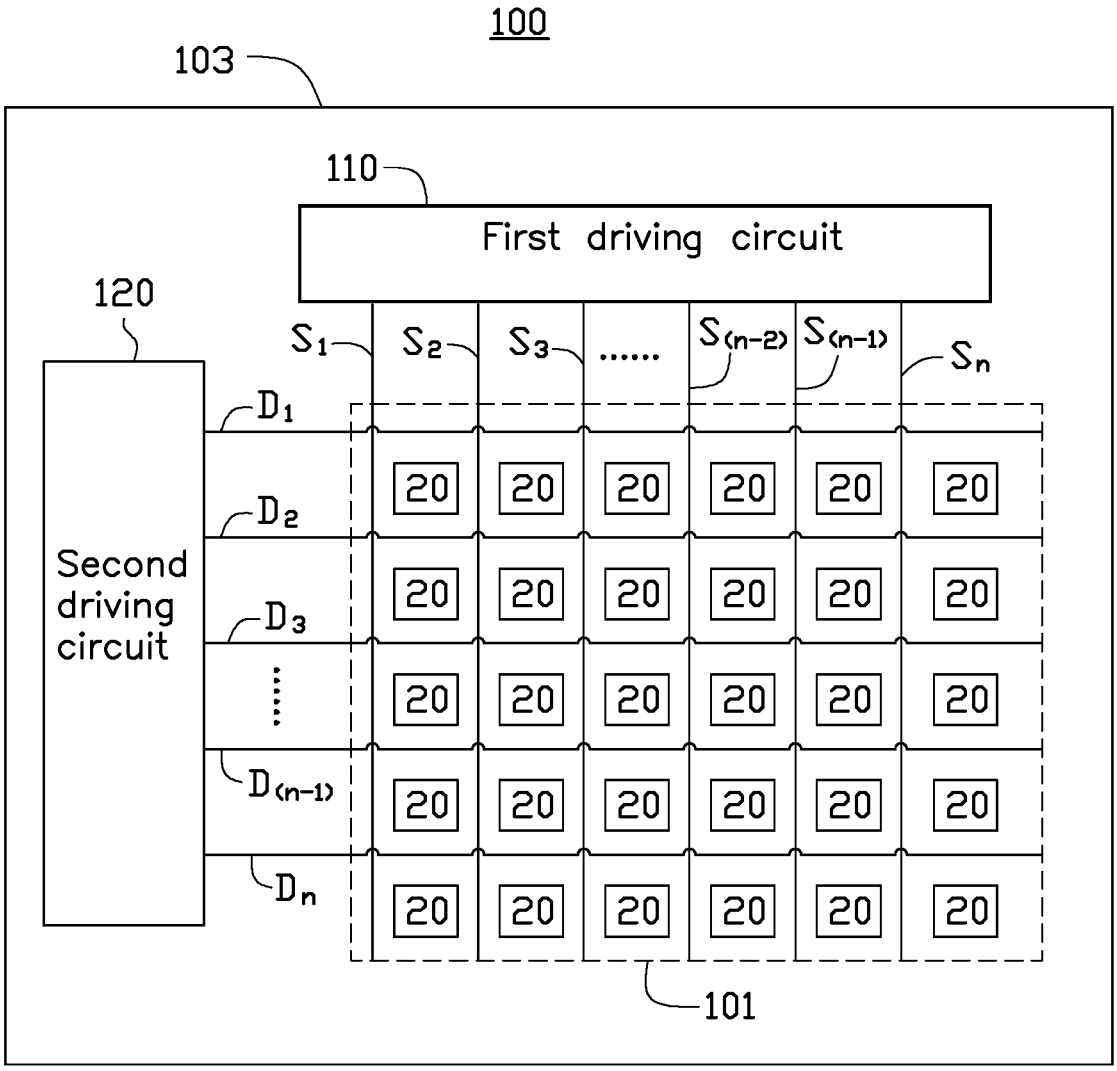
FIG. 1 is a plan view of an exemplary embodiment of a display apparatus, the display apparatus comprises a plurality of driving circuits.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "comprising" means "including, but not necessarily limited to"; it specifically indicates open-ended inclusion or membership in a so-described combination, group, series and the like.

As discussed above, electrical characteristics of the driving transistor are degraded based on a driving time. Exemplary embodiments of the present application relate to a display apparatus that substantially compensates the electrical characteristics of the driving transistor in the pixel driving circuit. According to exemplary embodiments of the present application, the electrical characteristics of the driving transistor are compensated.

Figure 2:
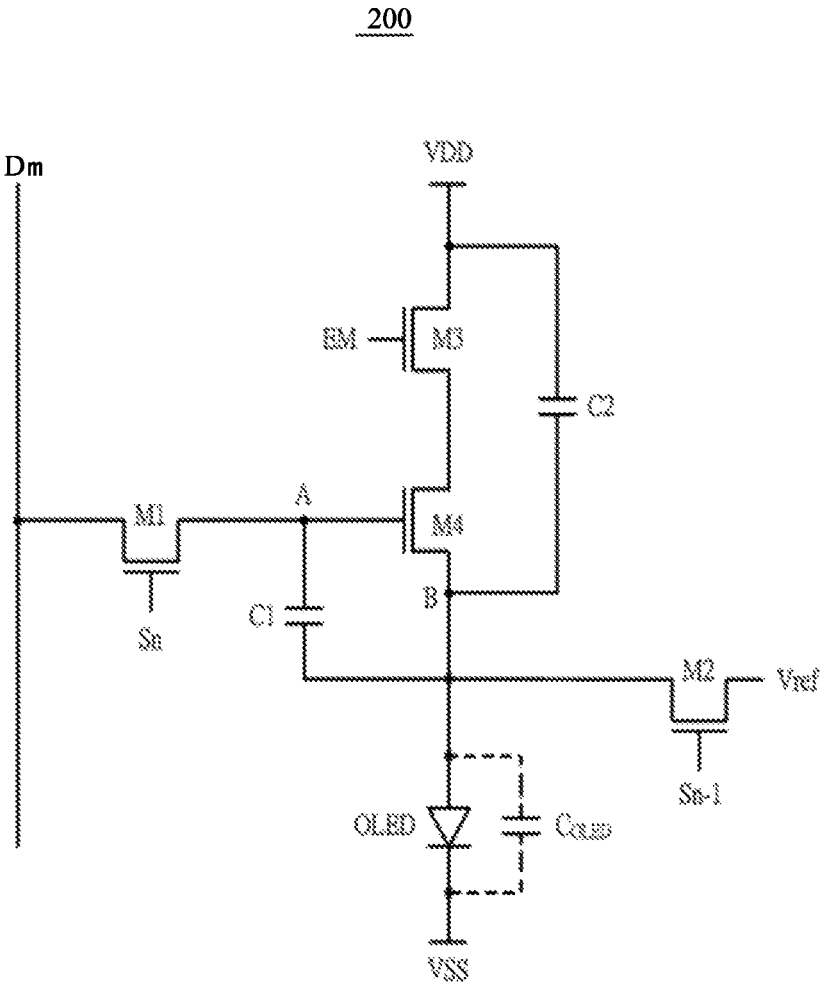
FIG. 2 is a circuit diagram view of a first exemplary embodiment of the driving circuit connected with a data scan line, a first scan line, a second scan line, and a third line of FIG. 1.

FIG. 1 illustrates an exemplary embodiment of a display apparatus 100. In at least one exemplary embodiment, the display apparatus 100 is for example an organic light emitting diode (OLED) device. The display apparatus 100 defines a display region 101 and a non-display region 103 surrounded with the display region 101. The display apparatus 100 includes a plurality of scan lines $S_1$-$S_n$ extending along a first direction X and a plurality of data lines $D_1$-$D_m$ extending along a second direction Y perpendicular to the first direction X. The scan lines $S_1$-$S_n$ and the data lines $D_1$-$D_m$ cross with each other in a grid to define a plurality of pixel units 20. The scan lines $S_1$-$S_n$ are insulated from the data lines $D_1$-$D_m$. The scan lines $S_1$-$S_n$ are electrically connected to a first driving circuit 110, and the data lines $D_1$-$D_m$ are electrically connected to a second driving circuit 120. Main portions of the scan lines $S_1$-$S_n$ and the data lines $D_1$-$D_m$ are located in the display region 101. The first driving circuit 110 and the second driving circuit 120 are located on the non-display region 103. In at least one exemplary embodiment, the first driving circuit 110 is located upon the display region 101, and the second driving circuit 120 is located on a left side of the display region 101. The first driving circuit 110 can be a gate driving circuit, and the second driving circuit 120 can be a source driving circuit configured to provide data signals to each pixel unit 20. Each of the pixel units 20 includes to a pixel driving circuit 200 (as shown in FIG. 2). The first driving circuit 110 sequentially outputs scan driving signals to the pixel units 20.

FIG. 2 illustrates a first exemplary embodiment of the pixel driving circuit 200 corresponding to one of the pixel units 20. The pixel driving circuit 200 receives signals from a first scan line $S_n$, a second scan line $S_{n-1}$, a control line EM, and a data line $D_m$. The pixel driving circuit 200 further receives a first direct current (DC) voltage from a power terminal $V_{DD}$, a second voltage from an initial terminal $V_{ref}$, and a third voltage from a ground terminal $V_{SS}$. The pixel driving circuit 200 is a is formed as a 4T-2C type driving circuit, and includes a switching transistor M1, a reset transistor M2, a first transistor M3, a driving transistor M4, an organic light emitting diode (OLED), a first capacitor C1, and a second capacitor C2. The OLED further includes a spastic capacitor $C_{OLED}$. The switching transistor M1, the reset transistor M2, and the first transistor M3 are respectively controlled by the signal on the first scan line $S_1$, the second scan line $S_2$, and the control line EM. The driving transistor M4 controls a current following through the OLED. The switching transistor M1 controls an operation to supply an electric potential of the data line $D_m$ to the driving transistor M4. The first capacitor C1 stores the electric potential on the data line $D_m$ during one frame, and cooperates with the second capacitor C2 to divide the electric potential at the second node B. The reset transistor M2 controls an operation to supply a signal electric potential on the second scan line $S_{n-1}$ to a source electrode of the driving transistor M4. The first transistor M3 controls a current from the power terminal $V_{DD}$ to be supplied to the OLED. In at least one exemplary embodiment, the switching transistor M1, the reset transistor M2, the first transistor M3, and the driving transistor M4 can be a n-type polysilicon thin film transistors. In other embodiments, the switching transistor M1, the reset transistor M2, the first transistor M3, and the driving transistor M4 can be n-type amorphous silicon thin film transistors. In at least one exemplary embodiment, the first scan line $S_n$ and the second scan line $S_{n-1}$ are two adjacent lines of the scan lines $S_1$-$S_n$, and the data line $D_m$ is one of the data lines $D_1$-$D_m$. That is, each pixel unit 20 corresponds to or connects to two adjacent scan lines and one date line. A gate electrode of the switching transistor M1 is electrically to the scan line $S_n$, and a gate electrode of the reset transistor M2 is electrically connected to the adjacent scan line $S_{(n-1)}$, and a gate electrode of the first transistor M3 is electrically connected to the control line EM.

A gate electrode of the switching transistor M1 is electrically connected to the first scan line $S_n$, a source electrode of the switching transistor M1 is electrically connected to the data line $D_m$, and a drain electrode of the switching transistor M1 is electrically connected to a gate electrode of the driving transistor M4. A first node A is electrically connected between the drain electrode of the switching transistor M1 and the gate electrode of the driving transistor M4. A drain electrode of the driving transistor M4 is electrically connected to a source electrode of the first transistor M3, and a source electrode of the driving transistor M4 is electrically connected to an anode of the OLED. A second node B is electrically connected between the source electrode of the driving transistor M4 and the anode of the OLED the OLED. A cathode of the OLED is electrically connected to the ground terminal $V_{SS}$. A gate electrode of the first transistor M3 is electrically connected to the control line EM, and a drain electrode of the first transistor M3 is electrically connected to the power terminal $V_{DD}$. A gate electrode of the reset transistor M2 is electrically connected to the second scan line $S_{n-1}$, a drain electrode of the reset transistor M2 is electrically connected to the second node B, and a source electrode of the reset transistor M2 is electrically connected to the initial terminal $V_{ref}$. Two opposite terminals of the first capacitor C1 are electrically connected to the gate electrode of the driving transistor M4 and the source electrode of the driving transistor M4 respectively. Two opposite terminals of the parasitic capacitor $C_{OLED}$ are electrically connected between the anode of the OLED and the cathode of the OLED respectively. One terminal of the second capacitor C2 is electrically connected to the drain electrode of the first transistor M3, and another terminal of the second capacitor C2 is electrically connected to the source electrode of the driving transistor M4. In at least one exemplary embodiment, signals provided on the first scan line $S_n$, the second scan line $S_{n-1}$, and the control line EM are switched between a low level voltage and a high level voltage, and the signal provided by the data line $D_m$ is switched between an offset electric potential $V_{bias}$ and a signal electric potential $V_{data}$. The offset electric potential $V_{bias}$ is lower than the signal electric potential $V_{data}$. The offset electric potential $V_{bias}$ is served as a reference voltage of the signal electric potential $V_{data}$ (equivalent to be a black level), and the signal electric potential $V_{data}$ is a voltage of video signal to be displayed by the display apparatus 100. In at least one exemplary embodiment, the power terminal $V_{DD}$ supplies a specified voltage, and connects with all the pixel units 20 respectively. The specified voltage is a high level voltage, and is capable of providing a current to the OLED during the first transistor M3 turns on. In at least one exemplary embodiment, the initial terminal $V_{ref}$ is in a low level voltage state.

Furthermore, the driving transistor M4 is a driving thin film transistor, employed to drive the OLED to emit light.

Figure 3:
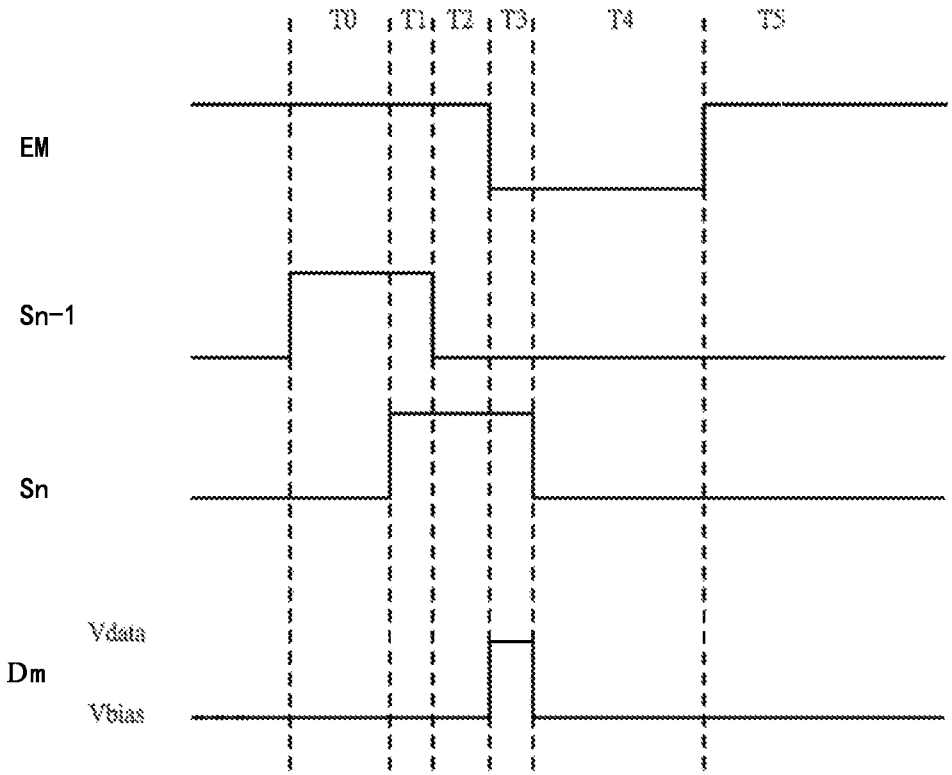
FIG. 3 is a diagrammatic view of the driving circuit of FIG. 2.

FIG. 3 illustrates a timing diagram of a signal of the control line EM, a scanning signal of the first scan line $S_n$, a scanning signal of the second scan line $S_{n-1}$, the data signal provided on the data line $D_m$ of the pixel driving circuit 200. The pixel driving circuit 200 operates sequentially within one frame time comprising a reset period T0, a preparation compensation period T1, a compensation period T2, a programming period T3, an illumination duty period T4, and an illumination period T5.

During the reset period T0, the pixel driving circuit 200 is reset and the OLED stops emitting light. During the preparation compensation period T1, the first capacitor C1 is being charged for compensating a threshold voltage degradation of the driving transistor M4. During the compensation period T2, the electric potential of the second node B rises based on the current flowing from the driving transistor M4 to the first capacitor C1. During the programming period T3, the data signal on the data line $D_m$ is supplied to the gate of the driving transistor M4. During the illumination duty period T4, the pixel driving circuit 200 remains the electric potential of the second node B. During the illumination period T5, a current is supplied to the OLED for emitting light by sequentially passing through the first transistor M3 and the driving transistor M4.

Figure 4:
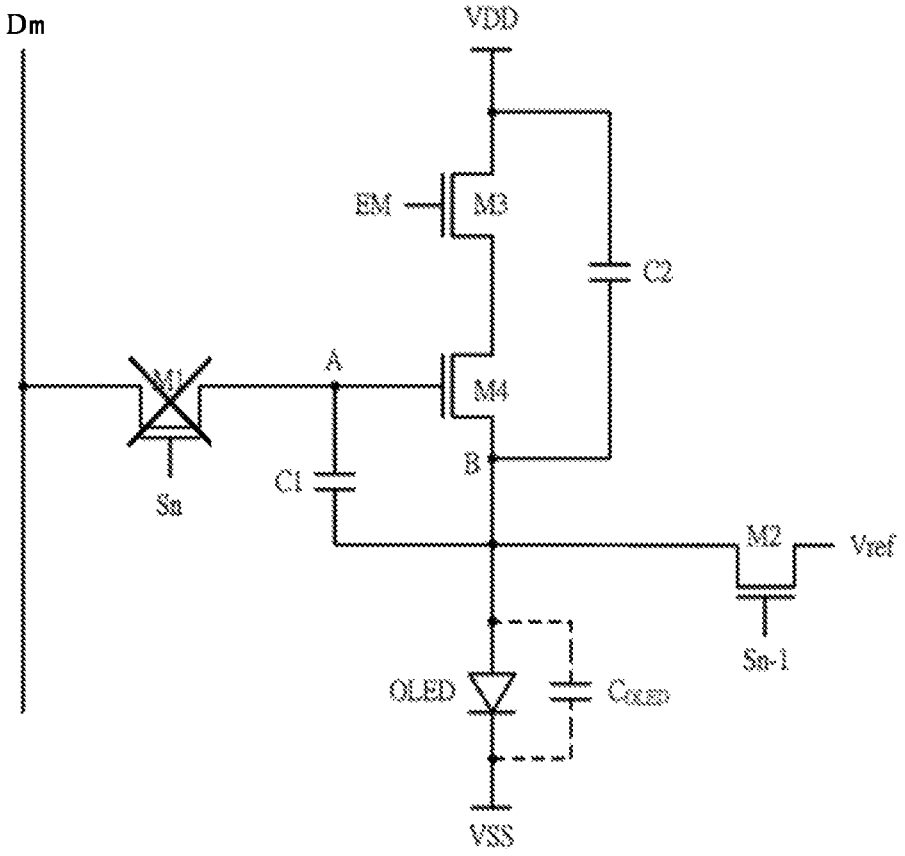
FIG. 4 is a circuit diagram view of the driving circuit of FIG. 2 in a rest period.

FIG. 4 is a circuit diagram view of the pixel driving circuit 200 in the reset period T0. During the reset period T0, the scanning signal of the first scan line $S_{n-1}$ and the control signal EM are in high level voltage, and the scanning signal of the second scan line $S_n$ is in low level voltage, and the offset electric potential $V_{bias}$ is provided to the data line $D_m$. The switching transistor M1 is turned off. The reset transistor M2 and the first transistor M3 remain in a turned-on state. The electric potential of the second node B is equal to the reference voltage $V_{ref}$. When the reference voltage $V_{ref}$ is less than the second voltage $V_{SS}$, the voltage difference between the anode and the cathode of the OLED is less than a forward voltage of the OLED, the OLED will be in a non-luminance state.

Figure 5:
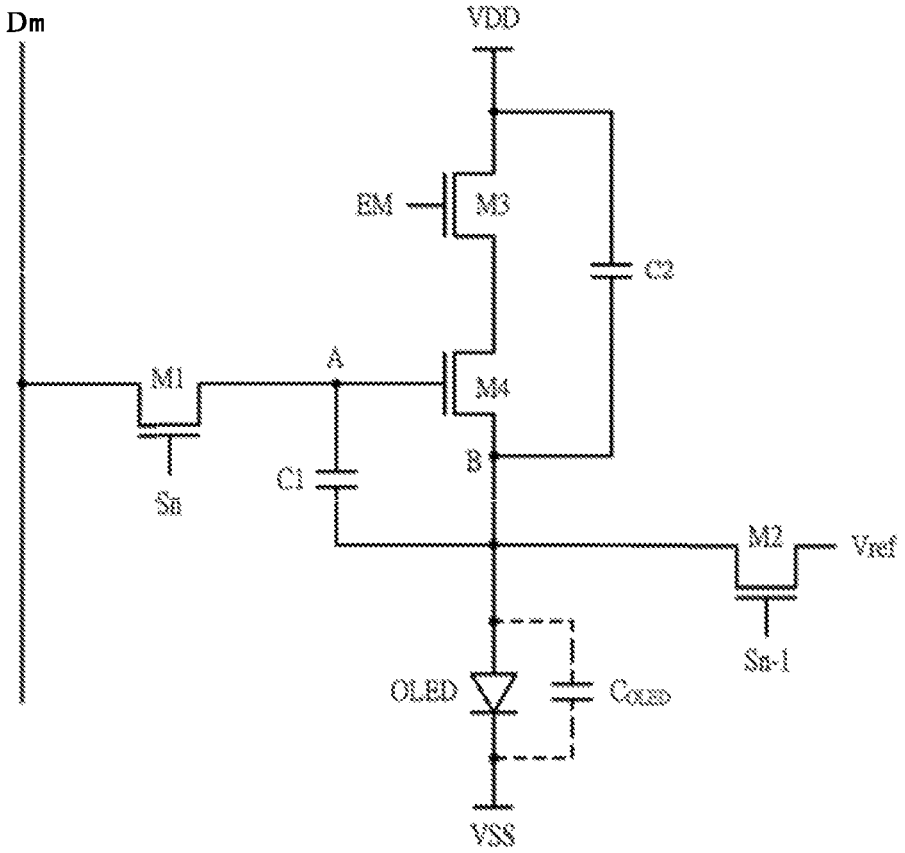
FIG. 5 is a circuit diagram view of the driving circuit of FIG. 2 in a preparation compensation period.

FIG. 5 is a circuit diagram view of the pixel driving circuit 200 in the preparation compensation period T1. During the preparation compensation period T1, the scanning signals of the first scan line $S_{n-1}$, the second scan line $S_n$, and the control signal EM are in high level voltage, and the offset electric potential $V_{bias}$ is provided to the data line $D_m$. The offset electric potential $V_{bias}$ is provided to the gate electrode of the driving transistor M4, and the first capacitor C1 is charged. The difference between the offset electric potential $V_{bias}$ and the ground terminal $V_{SS}$ is larger than a threshold voltage of the driving transistor M4, thus the driving transistor M4 turns on. The electric potential of the first node A is equal to the offset electric potential $V_{bias}$, and the electric potential of the second node B is equal to the initial terminal $V_{ref}$. The voltage difference between the anode and the cathode of the OLED is less than the forward voltage of the OLED, the OLED to maintain in the non-luminance state.

Figure 6:
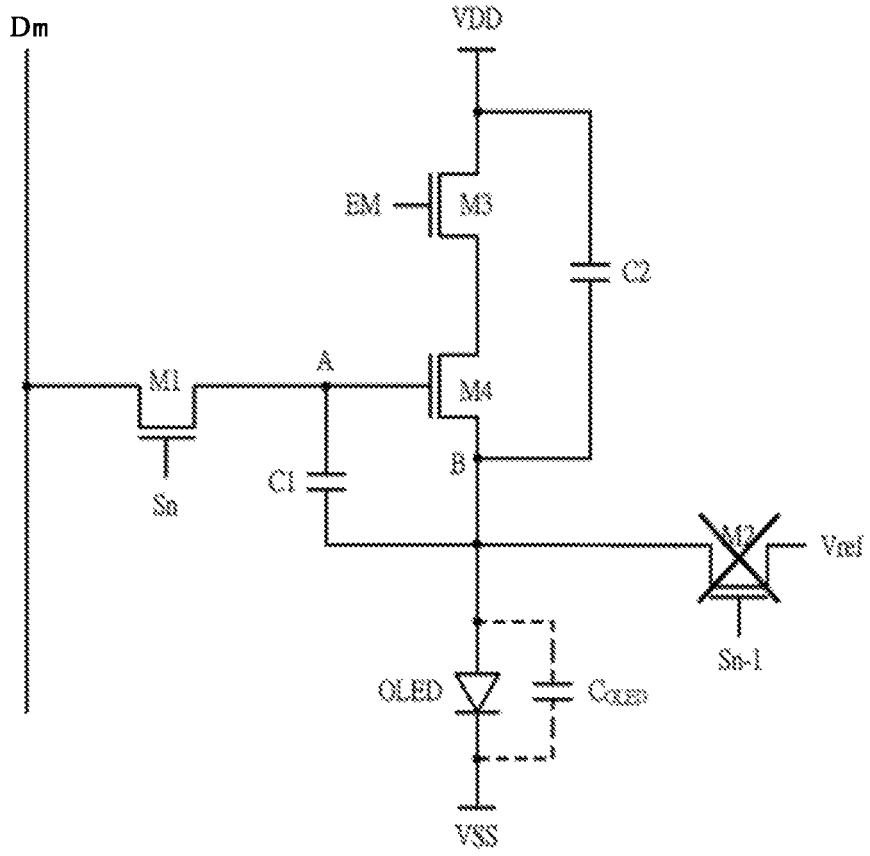
FIG. 6 is a circuit diagram view of the driving circuit of FIG. 2 in a compensation period.

FIG. 6 is a circuit diagram view of the pixel driving circuit 200 in the compensation period T2. During the compensation period T2, the scanning signal of the second scan line $S_n$ and the signal of the control signal EM are in high level voltage, the scanning signal of the first scan line $S_{n-1}$ is in low level voltage, and the offset electric potential $V_{bias}$ is provided to the data line $D_m$. The reset transistor M2 is turned off. The electric potential of the second node B starts rise based a current flowing from the first transistor M3 and the driving transistor M4. The electric potential of the second node B is equal to a difference between offset electric potential $V_{bias}$ and a threshold voltage of the driving transistor M4. The voltage difference between the anode and the cathode of the OLED is less than the forward voltage of the OLED, the OLED to maintain in the non-luminance state.

Figure 7:
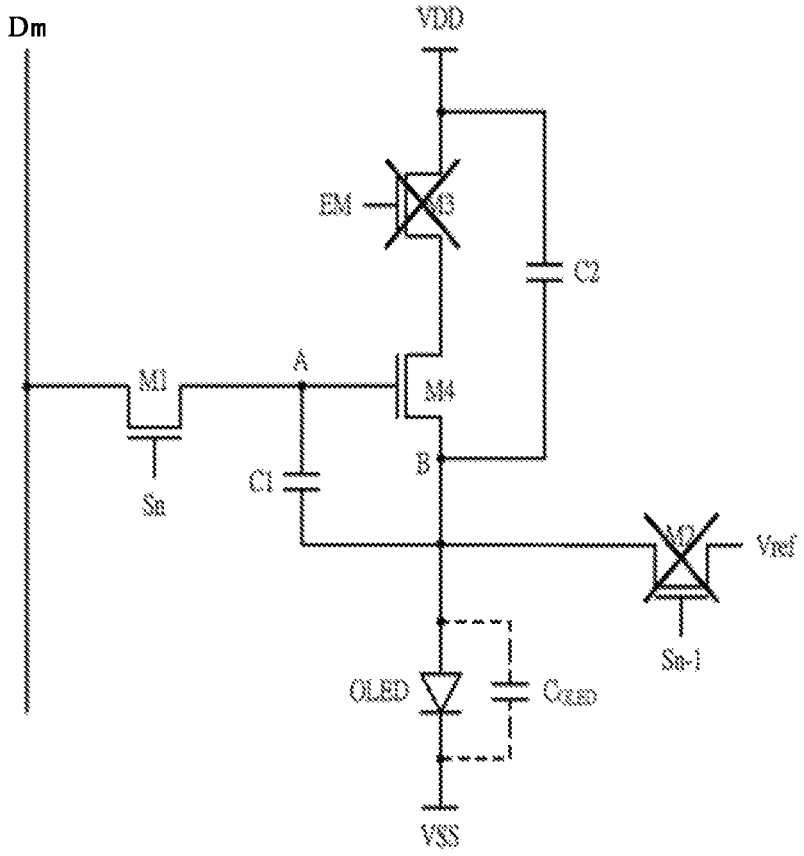
FIG. 7 is a circuit diagram view of the driving circuit of FIG. 2 in a programming period.

FIG. 7 is a circuit diagram view of the pixel driving circuit 200 in the programming period T3. During the programming period T3, the scanning signals of the second scan line $S_n$ is in high level voltage, the scanning signal of the first scan line $S_{n-1}$ and the control signal EM is in low level voltage, and the signal electric potential $V_{data}$ is provided to the data line $D_m$. The reset transistor M2 remains in the turned off state, and the first transistor M3 is turned off. The signal electric potential $V_{data}$ is provided to the gate electrode of the driving transistor M4 by passing through the switching transistor M1, thus the driving transistor M4 turns on. The capacitor $C_{OLED}$ is charged by the difference of the signal electric potential $V_{data}$ and the offset electric potential $V_{bias}$, and thus the electric potential of the second node B rises. The electric potential of the second node B is a sum of the electric potential at the compensation period and the electric potential risen by the charged capacitor $C_{OLED}$. The electric potential of the second node B is calculated by the following formula:

$$V_B=V_{bias}-V_{th}+[(V_{data}-V_{bias})C1/(C1+C_{OLED})] \quad (1)$$

The voltage difference between the anode and the cathode of the OLED is less than the forward voltage of the OLED, which cause the OLED to maintain in the non-luminance state.

Figure 8:
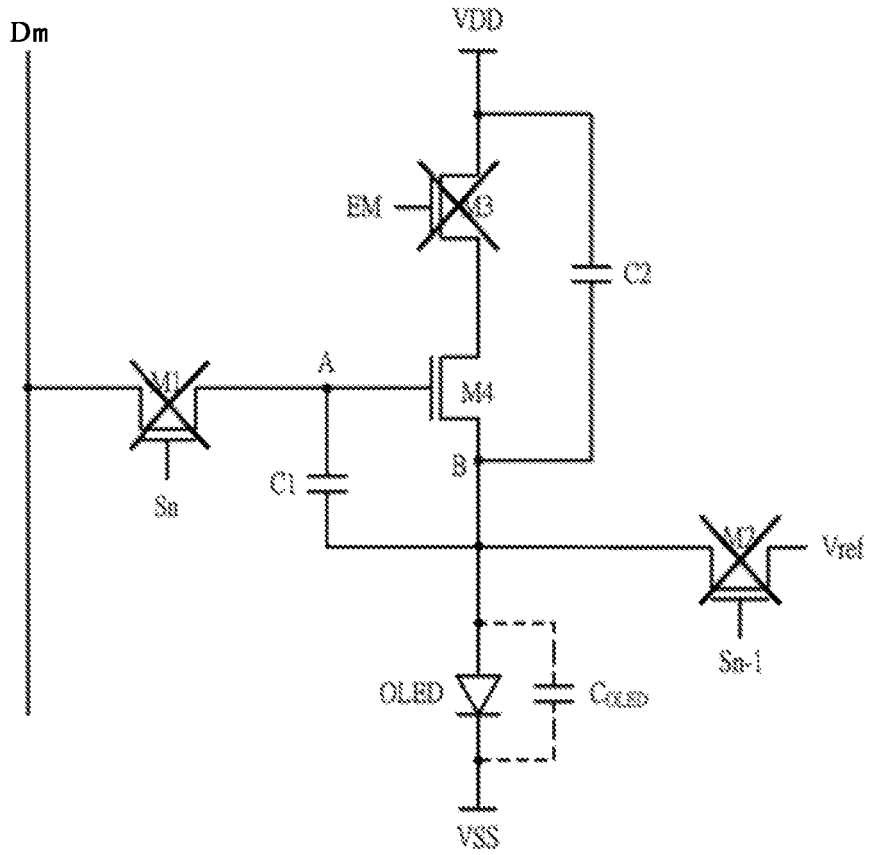
FIG. 8 is a circuit diagram view of the driving circuit of FIG. 2 in an illumination duty period.

FIG. 8 is a circuit diagram view of the pixel driving circuit 200 in the illumination duty period T4. During the illumination duty period T4, the scanning signals of the second scan line $S_n$, the first scan line $S_{n-1}$, and the signal of the control signal EM is in low level voltage, and the offset electric potential $V_{bias}$ is provided to the data line $D_m$. The switching transistor M1 turns off, and the reset transistor M2 and the first transistor M3 remains in the turned off state. The illumination duty period T4 is an adjustment period for adjusting the luminescence of the OLED. The electric potential of the second node B remains being equal to the electric potential of the second node B in the programming period T3. The voltage difference between the anode and the cathode of the OLED is less than the forward voltage of the OLED, which cause the OLED to maintain in the non-luminance state.

Figure 9:
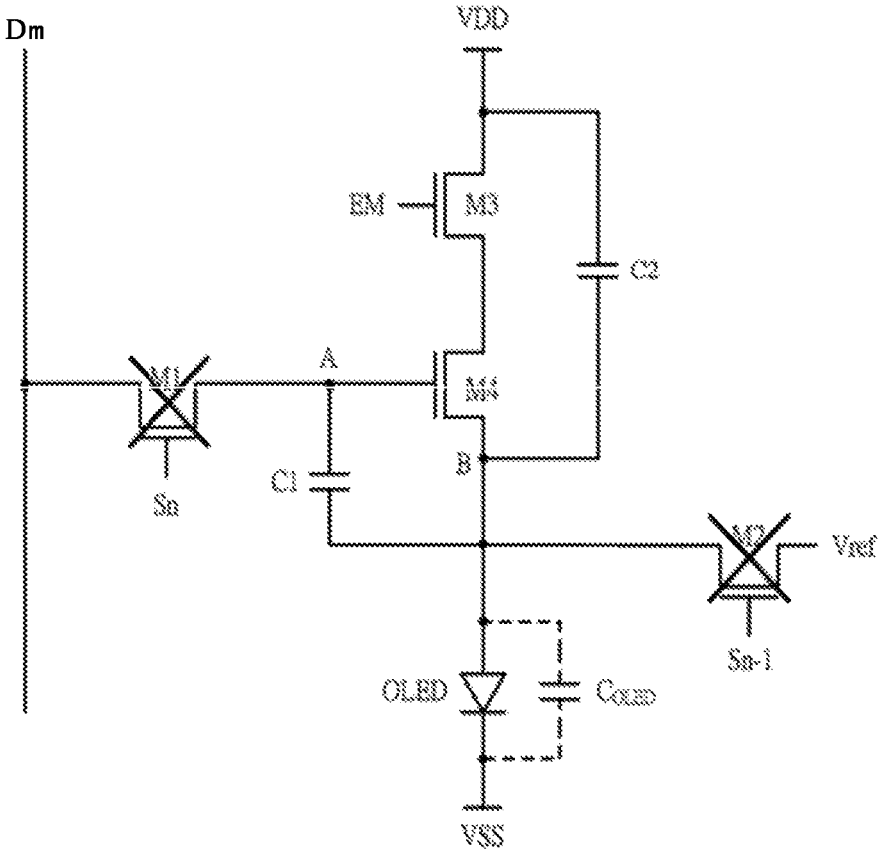
FIG. 9 is a circuit diagram view of the driving circuit of FIG. 2 in an illumination period.

FIG. 9 is a circuit diagram view of the pixel driving circuit 200 in the illumination period T5. During the illumination period T5, the signal of the control signal EM is in high level voltage, the scanning signals of the first scan line $S_{n-1}$ and the second scan line $S_n$ are in low level voltage, and the offset electric potential $V_{bias}$ is provided to the data line $D_m$. The switching transistor M1 and the reset transistor M2 remain in a turned off state, thus the gate electrode of the driving transistor M4 is floated. The electric potential of the first node A is calculated according to the follow formula:

$$V_A=V_{data}+(V_{OLED}-[(V_{bias}-V_{th})+(V_{data}-V_{bias})*C1/(C1+C2+C_{OLED})]) \quad (2)$$

The control signal EM is in the high level voltage, the first transistor M3 is turned on, and the driving transistor M4 further supplies the current to the OLED. The electric potential of the second node B is more than the forward voltage of the OLED. The voltage difference between the anode and the cathode of the OLED is more than the forward voltage of the OLED, which cause the OLED to emit light.

The current of the OLED is calculated according to the follow formula:

$$\begin{aligned} I_{OLED} &= k*(V_{GS}-V_{th})^2 \\ &= k*(V_A-V_B-V_{th})^2 \\ &= k*\{(V_{data}-V_{bias})*[1-C1/(C1+C2+C_{OLED})]\}^2 \end{aligned} \quad (3)$$

$$k = 1/2*\mu*C_{OX}*W/L \quad (4)$$

μ represents a mobility ratio of the driving transistor M4, $C_{OX}$ represents a capacitance of the gate dielectric layer of the driving transistor M4. W represents a width of the channel of the driving transistor M4. L represents a length of the channel of the driving transistor M4.

In the structure of the pixel driving circuit under the periods in one frame, due to the illumination duty period, the illumination time of the OLED can be adjusted. Thereby, a performance of the display apparatus is improved. The gate electrodes of the switching transistor and the reset transistor are electrically connected to the two adjacent scan lines, thus the number of the shift register module for driving the pixel driving circuit is reduced.

Figure 10:
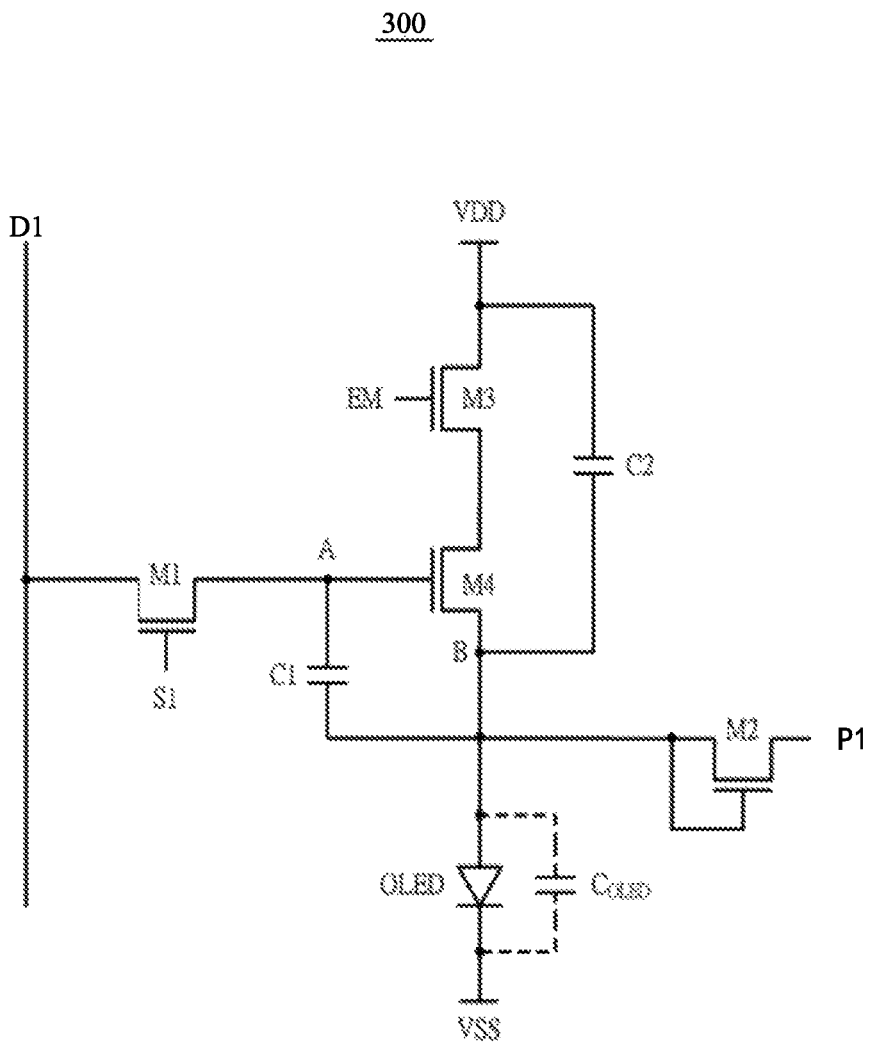
FIG. 10 is circuit diagram of a second exemplary embodiment of the driving circuit connected with a data scan line, a first scan line, a second scan line, and a third line of FIG. 1.

FIG. 10 illustrates a second exemplary embodiment of the pixel driving circuit 300 corresponding to one of the pixel units 20. The pixel driving circuit 300 receives signals from a first scan line $S_1$, a second scan line P1, a control line EM, and a data line $D_1$. The pixel driving circuit 300 further receives a first direct current (DC) voltage from a power terminal $V_{DD}$ and a voltage from a ground terminal $V_{SS}$. The pixel driving circuit 300 is a is formed as a 4T-2C type driving circuit, and includes a switching transistor M1, a reset transistor M2, a first transistor M3, a driving transistor M4, an organic light emitting diode (OLED), a first capacitor C1, and a second capacitor C2. The OLED includes a spastic capacitor $C_{OLED}$. The switching transistor M1, the reset transistor M2, and the first transistor M3 are respectively controlled by the signal on the first scan line $S_1$, the second scan line P1, and the control line EM. The driving transistor M4 controls a current following through the OLED. The switching transistor M1 controls an operation to supply an electric potential on the data line $D_1$ to the driving transistor M4. The first capacitor C1 stores the electric potential on the data line $D_1$ during one frame, and cooperates with the second capacitor C2 to divide an electric potential at the second node B. The reset transistor M2 serves as a diode and controls an operation to supply an alternating current AC to a source electrode of the driving transistor M4. The first transistor M3 controls a current from the power terminal $V_{DD}$ to be supplied to the OLED. In at least one exemplary embodiment, the first switching transistor M1, the reset transistor M2, the first transistor M3, and the driving transistor M4 can be a n-type polysilicon thin film transistors. In other exemplary embodiments, the switching transistor M1, the reset transistor M2, the first transistor M3, and the driving transistor M4 can be n-type amorphous silicon thin film transistors. A gate electrode of the switching transistor M1 is electrically connected to the scan line S1, and a source electrode of the reset transistor M2 is electrically connected to the control line EM.

A gate electrode of the switching transistor M1 is electrically connected to the first scan line Si, a source electrode of the switching transistor M1 is electrically connected to the data line $D_1$, and a drain electrode of the switching transistor M1 is electrically connected to a gate electrode of the driving transistor M4. A first node A is electrically connected between the drain electrode of the switching transistor M1 and the gate electrode of the driving transistor M4. A drain electrode of the driving transistor M4 is electrically connected to a source electrode of the first transistor M3, and a source electrode of the driving transistor M4 is electrically connected to an anode of the OLED. A second node B is electrically connected between the drain source electrode of the driving transistor M4 and the anode of the OLED. A cathode of the OLED is electrically connected to the ground terminal $V_{SS}$. A gate electrode of the first transistor M3 is electrically connected to the control line EM, and a drain electrode of the first transistor M3 is electrically connected to the power terminal $V_{DD}$. A gate electrode of the reset transistor M2 is electrically connected to a drain electrode of the reset transistor M2, the drain electrode of the reset transistor M2 is electrically connected to the second node B, and a source electrode of the reset transistor M2 is electrically connected to the second scan line P1. Two opposite terminals of the first capacitor C1 are electrically connected to the gate electrode of the driving transistor M4 and the source electrode of the driving transistor M4 respectively. Two opposite terminals of the parasitic capacitor $C_{OLED}$ are electrically connected between the anode of the OLED and the cathode of the OLED respectively. One terminal of the second capacitor C2 is electrically connected to the drain electrode of the first transistor M3, and another terminal of the second capacitor C2 is electrically connected to the source electrode of the driving transistor M4. In at least one exemplary embodiment, signals provided on the first scan line S1 and the control line EM are switched between a low level voltage and a high level voltage, and the signal provided by the data line $D_1$ is switched between an offset electric potential $V_{bias}$ and a signal electric potential $V_{data}$. The offset electric potential $V_{bias}$ is lower than the signal electric potential $V_{data}$. The offset electric potential $V_{bias}$ is served as a reference voltage of the signal electric potential $V_{data}$ (equivalent to be a black level), and the signal electric potential $V_{data}$ is a voltage of video signal to be displayed by the display apparatus 100. In at least one exemplary embodiment, the power terminal $V_{DD}$ supplies a specified voltage, and connects with all the pixel units 20 respectively, and the second scan line P1, is applied with an alternating signal with a predetermined frequency. The specified voltage is a high level voltage, and is capable of providing a current to the OLED when the first transistor M3 turns on.

Furthermore, the driving transistor M4 is a driving thin film transistor, employed to drive the organic light emitting diode to emit light.

Figure 11:
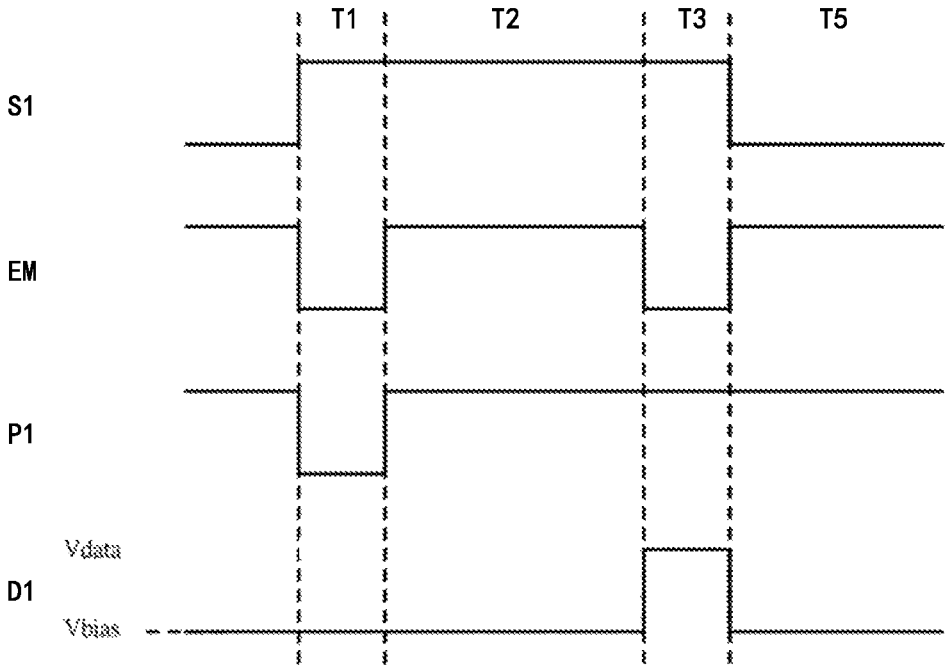
FIG. 11 is a diagrammatic view of the driving circuit of FIG. 10.

FIG. 11 illustrates a timing diagram of a signal of the control line EM, a scanning signal of the first scan line Si, a scanning signal of the second scan line P1, the data signal provided on the data line $D_1$ of the pixel driving circuit 300. The pixel driving circuit 300 operates sequentially within one frame time comprising a charging period T1, a compensation period T2, a programming period T3, and an illumination period T5.

During the charging period T1, the first capacitor C1 is being charged for compensating a threshold voltage degradation of the driving transistor M4. During the compensation period T2, the voltage of the second node B rises based on the current flowing from the driving transistor M4 to the first capacitor C1. During the programming period T3, the data on the data line $D_1$ is supplied to the gate of the driving transistor M4. During the illumination period T4, a current is supplied to the OLED for emitting light by sequentially passing through the third switching transistor M3 and the driving transistor M4.

Figure 12:
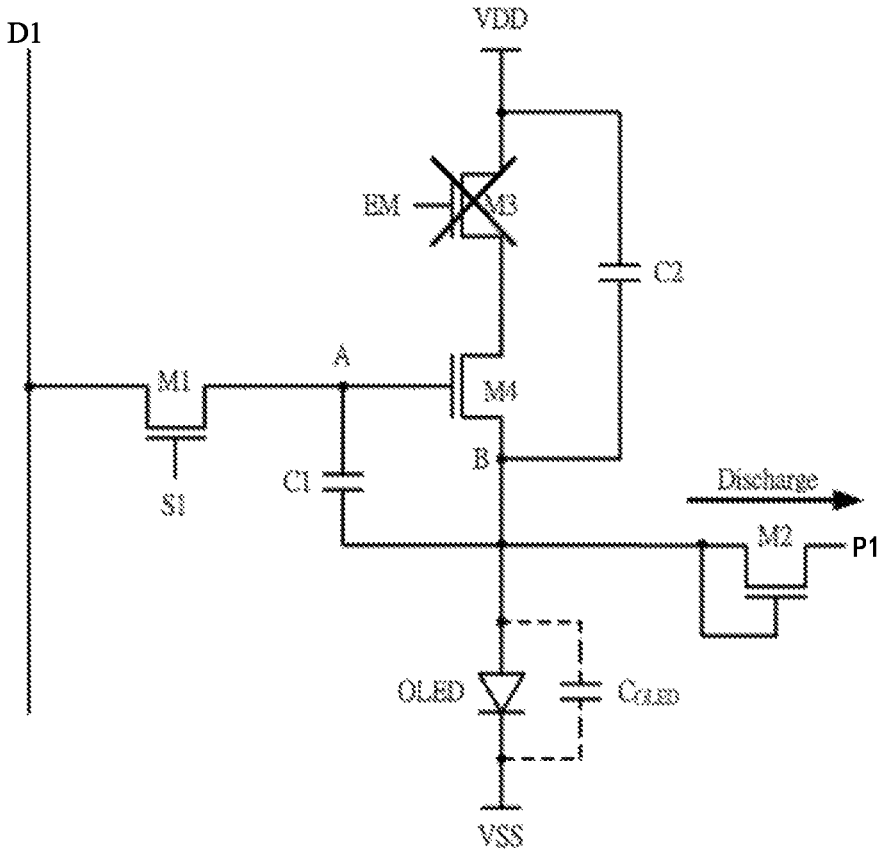
FIG. 12 is a circuit diagram view of the driving circuit of FIG. 10 in a preparation compensation period.

FIG. 12 is a circuit diagram view of the pixel driving circuit 300 in the charging period T1. During the charging period T1, the scanning signals of the first scan line $S_1$ is in high level voltage, the control signal EM and the second scan line P1 are in low level voltage, and the offset electric potential $V_{bias}$ is provided to the data line $D_1$. The first switching transistor M1 turns on, the offset electric potential $V_{bias}$ is provided to the gate electrode of the driving transistor M4 through the switching transistor M1, and the first capacitor C1 is charged. The difference between the offset electric potential $V_{bias}$ and the ground terminal $V_{ss}$ larger than a threshold voltage of the driving transistor M4, thus the driving transistor M4 turns on. The second capacitor C2 discharges through the reset transistor M2. The voltage of the first node A is still equal to the offset electric potential $V_{bias}$, and the voltage of the second node B is equal to a sum of the threshold voltage of the reset transistor M2 and the electric potential of the second scan line P1, and is less than the forward voltage of the OLED. The voltage difference between the anode and the cathode of the OLED is less than the forward voltage of the OLED, the OLED will not be illuminated.

Figure 13:
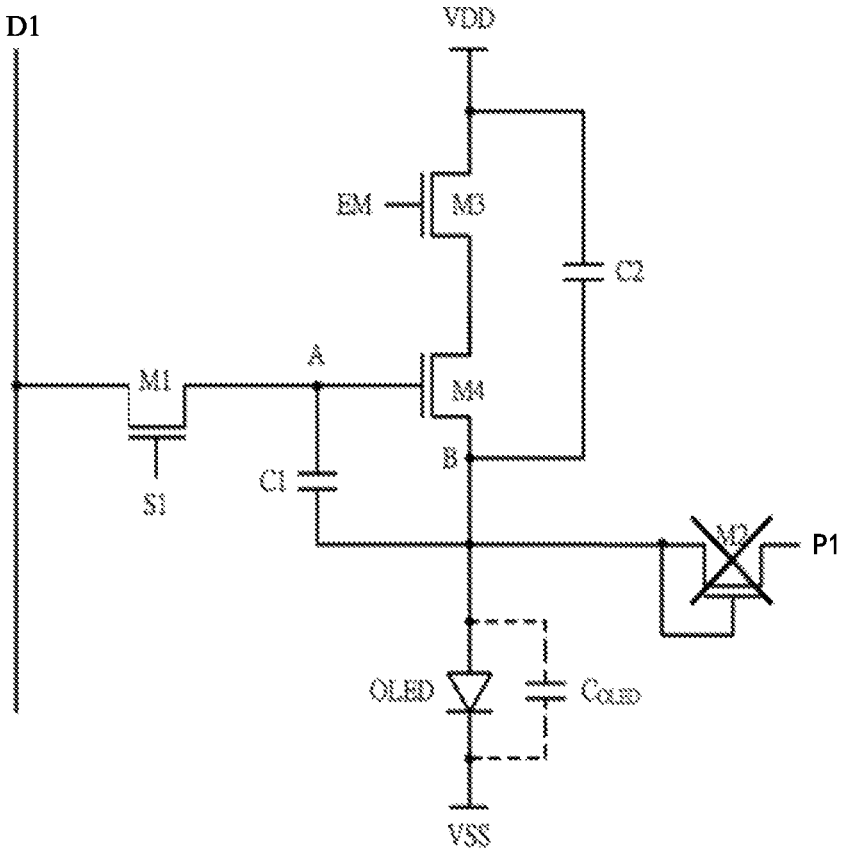
FIG. 13 is a circuit diagram view of the driving circuit of FIG. 10 in a compensation period.

FIG. 13 is a circuit diagram view of the pixel driving circuit 300 in the compensation period T2. During the compensation period T2, the scanning signals of the first scan line $S_1$, the second scan line P1, and the signal of the control signal EM are in high level voltage, and the offset electric potential $V_{bias}$ is provided to the data line $D_1$. The first transistor M3 turns on, and the voltage of the second node B starts rise based a current flowing from the first transistor M3 and the driving transistor M4. The voltage of the second node B is equal to a difference between offset electric potential $V_{bias}$ and the threshold voltage of the driving transistor M4. The voltage difference between the anode and the cathode of the OLED is less than the forward voltage of the OLED, the OLED to maintain in the non-luminance state.

Figure 14:
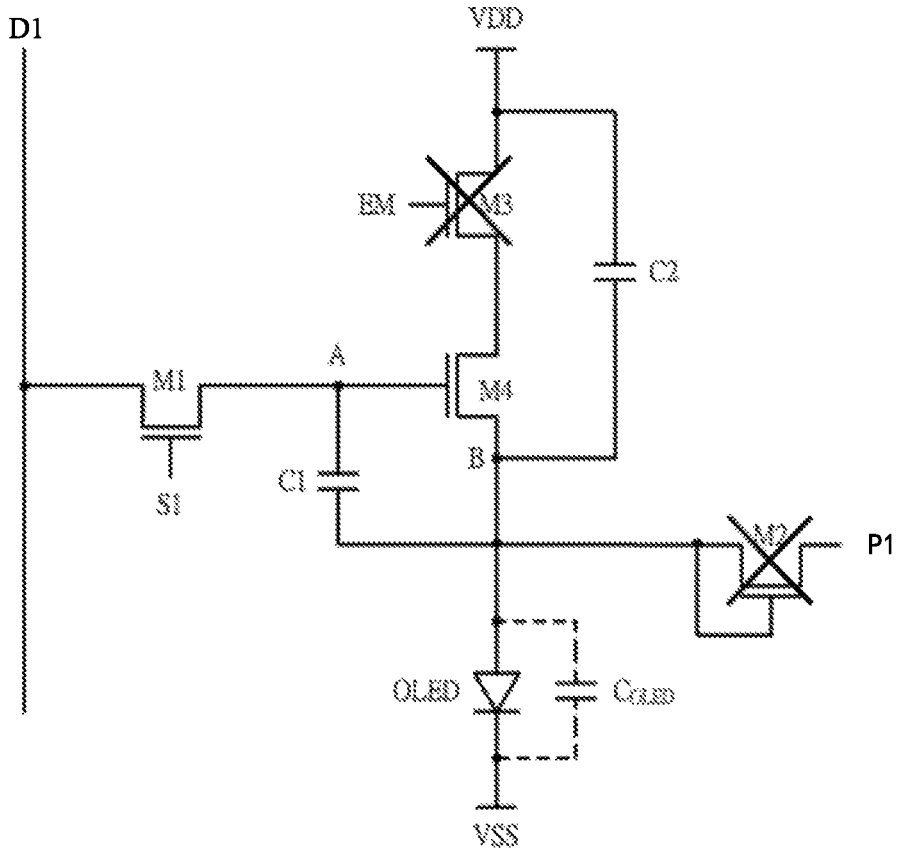
FIG. 14 is a circuit diagram view of the driving circuit of FIG. 10 in a programming period.

FIG. 14 is a circuit diagram view of the pixel driving circuit 300 in the programming period T3. During the programming period T3, the scanning signals of the first scan line $S_1$ and the power line P1 is in high level voltage, the control signal EM is in low level voltage, and the signal electric potential $V_{data}$ is provided to the data line D1. The reset transistor M2 remains in the turned off state, and the first transistor M3 is turned off. The signal electric potential $V_{data}$ is provided to the gate electrode of the driving transistor M4 by passing through the switching transistor M1, thus the driving transistor M4 turns on. The capacitor $C_{OLED}$ is charged by the difference of the signal electric potential $V_{data}$ and the offset electric potential $V_{bias}$, and thus the voltage of the second node B rises. The voltage of the second node B is a sum of the voltage at the compensation period and the voltage risen by the charged capacitor $C_{OLED}$. The voltage of the second node B is calculated by the following formula:

$$V_B=V_{bias}-V_{th}+[(V_{data}-V_{bias})C1/(C1+C_{OLED})] \quad (1)$$

The voltage difference between the anode and the cathode of the OLED is less than the forward voltage of the OLED, which cause the OLED to maintain in the non-luminance state.

Figure 15:
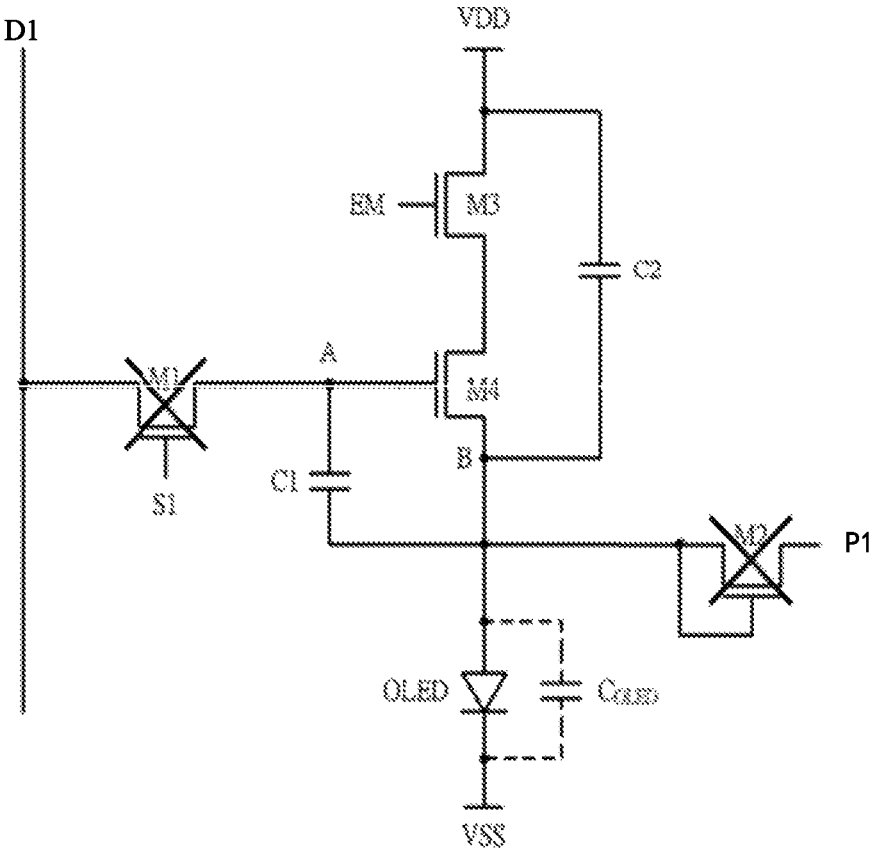
FIG. 15 is a circuit diagram view of the driving circuit of FIG. 10 in an illumination period.

FIG. 15 is a circuit diagram view of the pixel driving circuit 200 in the illumination period T5. During the illumination period T5, the scanning signal of the second scan line P1 is in high level voltage, the scanning signal of the first scan line $S_1$, and the signal of the control signal EM is in low level voltage, and the offset electric potential $V_{bias}$ is provided to the data line $D_1$. The first switching transistor M1 is turned off, thus the gate electrode of the driving transistor M4 is floated. The voltage of the first node A is calculated according to the follow formula:

$$V_A=V_{data}+(V_{OLED}-[(V_{bias}-V_{th})+(V_{data}-V_{bias})*C1/(C1+C2+C_{OLED})]) \quad (2)$$

The control signal EM is in the high level voltage, the first transistor M3 is turned on, and the driving transistor M4 further supplies the current to the OLED. The voltage of the second node B is equal to the forward voltage of the OLED. The voltage difference between the anode and the cathode of the OLED is more than the forward voltage of the OLED, which cause the OLED to emit light.

The current of the OLED is calculated according to the follow formula:

$$\begin{aligned} I_{OLED} &= k*(V_{GS}-V_{th})^2 \\ &= k*(V_A-V_B-V_{th})^2 \\ &= k*\{(V_{data}-V_{bias})*[1-C1/(C1+C2+C_{OLED})]\}^2 \end{aligned} \quad (3)$$

$$k = 1/2*\mu*C_{OX}*W/L \quad (4)$$

μ represents a mobility ratio of the driving transistor M4, $C_{OX}$ represents a capacitance of the gate dielectric layer of the driving transistor M4. W represents a width of the channel of the driving transistor M4. L represents a length of the channel of the driving transistor M4.

In the structure of the pixel driving circuit, the reset transistor serves as a diode, and connects with an alternating current (AC) voltage terminal. The gate electrode of the switching transistor is electrically connected to the scan line, and the first transistor is electrically connected to the control line, thus a number of the shift register modules for driving the pixel driving circuit is reduced.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including matters of shape, size, and arrangement of the parts within the principles of the present disclosure, up to and including the full extent established by the broad general meaning of the terms used in the claims.

What is claimed is:

1. A display apparatus comprising:

a plurality of scan lines;

a plurality of data lines;

a plurality of pixel units;

a first driving circuit for providing a plurality of scanning signals to the plurality of pixel units; and a plurality of pixel driving circuits each corresponding to one pixel unit of the plurality of pixel units, and configured to drive the corresponding one pixel unit;

wherein each pixel driving circuit comprises a switching transistor, a driving transistor, an organic light emitting diode (OLED) and a reset transistor, the OLED emits light when a current flows therethrough, the driving transistor controls the current flowing through the OLED, the switching transistor supplies a voltage of a data signal supplied by a corresponding data line of the plurality of data lines to the driving transistor in response to a corresponding first scan line of the plurality of scan lines being selected; a gate electrode of the reset transistor is electrically connected to a drain electrode of the reset transistor, and the drain electrode of the reset transistor is electrically connected to a source electrode of the driving transistor, a source electrode of the reset transistor is electrically connected to a second scan line, the reset transistor acts as a diode, and reduces a voltage applied to the driving transistor during a charging period under a control of the second scan line with a signal alternating between a first level voltage and a second level voltage, the second level voltage being less than the first level voltage; and during the charging period, the alternating signal is at the second level voltage, the reset transistor remains turned on, and a voltage of a source electrode of the driving transistor reduces to a sum of a threshold voltage of the reset transistor and a voltage of the second scan line.

2. The display apparatus of claim 1, wherein a source electrode of the reset transistor receives the alternating signal; a first terminal of a first capacitor is electrically connected to a gate electrode of the driving transistor and a second terminal of the first capacitor is electrically connected to an anode electrode of the OLED; a first terminal of a second capacitor is electrically connected to a drain electrode of a first transistor, and a second terminal of the second capacitor is electrically connected to the source electrode of the driving transistor.

3. The display apparatus of claim 2, wherein in one frame, the pixel driving circuit sequentially operates: the charging period, a compensation period, a data programming period, and an illumination period;

during the charging period, the second capacitor discharges;

during the compensation period, the first capacitor charges for compensating a threshold voltage of the driving transistor;

during the data programming period, the first capacitor charges by data signals applied by a corresponding data line; and during the illumination period, the OLED emits light beams.

4. The display apparatus of claim 1, wherein a source electrode of the switching transistor is electrically connected to the corresponding data line, and a drain electrode of the switching transistor is electrically connected to a gate electrode of the driving transistor; a drain electrode of the driving transistor is electrically connected to a source electrode of a first transistor, and the source electrode of the driving transistor is electrically connected to an anode of the OLED; a cathode of the OLED is electrically connected to a ground terminal; a drain electrode of the first transistor is electrically connected to a power terminal.

* * * * *